US006173659B1

(12) United States Patent
Danks et al.

(10) Patent No.: US 6,173,659 B1
(45) Date of Patent: Jan. 16, 2001

(54) CONVEYING PLATFORM

(75) Inventors: Christopher A. Danks, Waukesha; Randy H. Hafemeister, Watertown; James W. Hammond, Oconomowoc, all of WI (US); Ryan J. Andreae, Spirit Lake, IA (US)

(73) Assignee: Menasha Corporation, Neenah, WI (US)

( * ) Notice: Under 35 U.S.C. 154(b), the term of this patent shall be extended for 0 days.

(21) Appl. No.: 09/414,273

(22) Filed: Oct. 7, 1999

Related U.S. Application Data

(60) Provisional application No. 60/110,224, filed on Nov. 30, 1998.

(51) Int. Cl.[7] ..... B65D 19/38

(52) U.S. Cl. ..... 108/54.1; 108/901

(58) Field of Search ..... 108/54.1, 51.11, 108/56.1, 56.3, 901, 902, 57.26, 57.25; 288/188.2, 188.5, 346.02, 346.05

(56) References Cited

U.S. PATENT DOCUMENTS

| | | | | |
|---|---|---|---|---|
| 3,759,192 | * | 9/1973 | Oehler | 108/54.1 X |
| 4,216,933 | * | 8/1980 | Cramer | 108/56.1 X |
| 4,359,948 | * | 11/1982 | Judy et al. | 108/56.1 |
| 4,843,976 | * | 7/1989 | Pigott et al. | 108/56.3 X |
| 5,176,465 | * | 1/1993 | Holsted | 108/56.3 X |
| 5,483,899 | * | 1/1996 | Christie | 108/56.3 |
| 5,497,709 | * | 3/1996 | Gonzalez et al. | 108/56.3 |
| 6,021,721 | * | 2/2000 | Rushton | 108/56.3 |

* cited by examiner

*Primary Examiner*—Jose V. Chen
(74) *Attorney, Agent, or Firm*—Quarles & Brady LLP

(57) ABSTRACT

A load platform has telescoping feet which provide a variable height opening for insertion of material handling equipment forks. The pallet has a deck having a top and a bottom, and a number of legs which are formed extending downwardly from the deck. Feet connected by stringers are slidably connected to the legs providing a variable height opening defined by the deck bottom, stringer, and adjacent legs and feet.

14 Claims, 5 Drawing Sheets

CONVEYING PLATFORM

CROSS-REFERENCE TO RELATED APPLICATIONS

This application claims the benefit of U.S. Provisional Patent Application No. 60/110,224 filed Nov. 30, 1998.

STATEMENT REGARDING FEDERALLY SPONSORED RESEARCH OR DEVELOPMENT

Not Applicable.

FIELD OF THE INVENTION

The field of the invention is conveying platforms, more particularly, molded plastic conveying platforms having telescoping stringers.

BACKGROUND OF THE INVENTION

Load conveying platforms, such as pallets or bulk containers are in common use in many industries. They are used as load platforms for storing loads in a rack structure, transporting loads using material handling equipment, such as fork lift trucks, pallet jacks and the like, or conveying loads on a conveyor. A typical platform has a deck with an upper surface for supporting a load, a lower surface which is engaged by the material handling equipment when in transit, and an edge which is engaged by rack support arms when in storage. Feet depending downwardly from the deck lower surface support the deck on a supporting surface, such as the ground, raising it a distance above the ground to provide access for a fork truck to slip its forks under the deck to engage the lower surface.

The feet, however, decrease the conveyorability of the load platform, by decreasing the surface area in contact with conveyor rollers. Special conveyors having closely spaced rollers are often required to efficiently convey the platform. One method of improving the conveyorability of the platform is to mount stringers to the feet bottoms which span the space between adjacent feet. The stringers increase the surface area in contact with the conveyor rollers, increasing the platform conveyorability. Advantageously, the stringers also increase the pallet structural integrity, thus reducing deck deflection in an edge supported platform.

The stringers, feet and deck lower surface define an opening in which material handling equipment forks are inserted to engage the deck lower surface and lift the platform. Vertically adjustable forks on a pallet jack are often inserted into the opening and then raised to lift the pallet. If the pallet jack is resting on the stringer, the stringer may be damaged when the forks are raised. The damaged stringer may degrade conveyorability and reduce the load platform structural integrity.

SUMMARY OF THE INVENTION

The present invention provides a load platform having a deck and telescoping feet connected by stringers. The telescoping feet provide a variable height opening for insertion of material handling equipment forks between the load platform deck and stringer. The pallet deck has a top and a bottom, and a number of formed legs extending downwardly from the deck. Feet connected by stringers are slidably connected to the legs providing a variable height opening defined by the deck bottom, stringer, and adjacent legs and feet, thus accomplishing a general objective of providing a load platform having vertically adjustable openings for lifting forks. The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
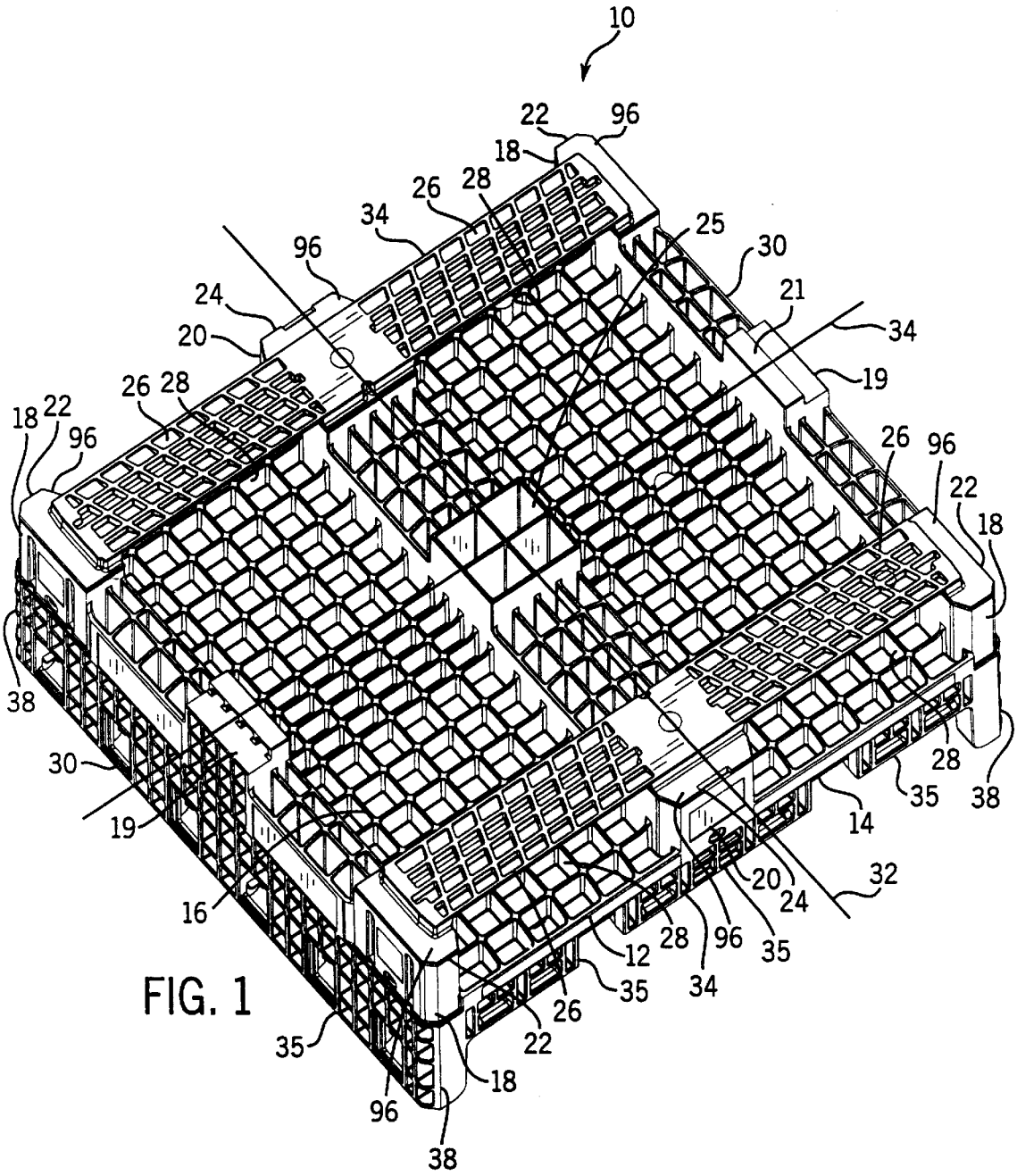
FIG. 1 is a bottom perspective view of a pallet incorporating the present invention.
Figure 2:
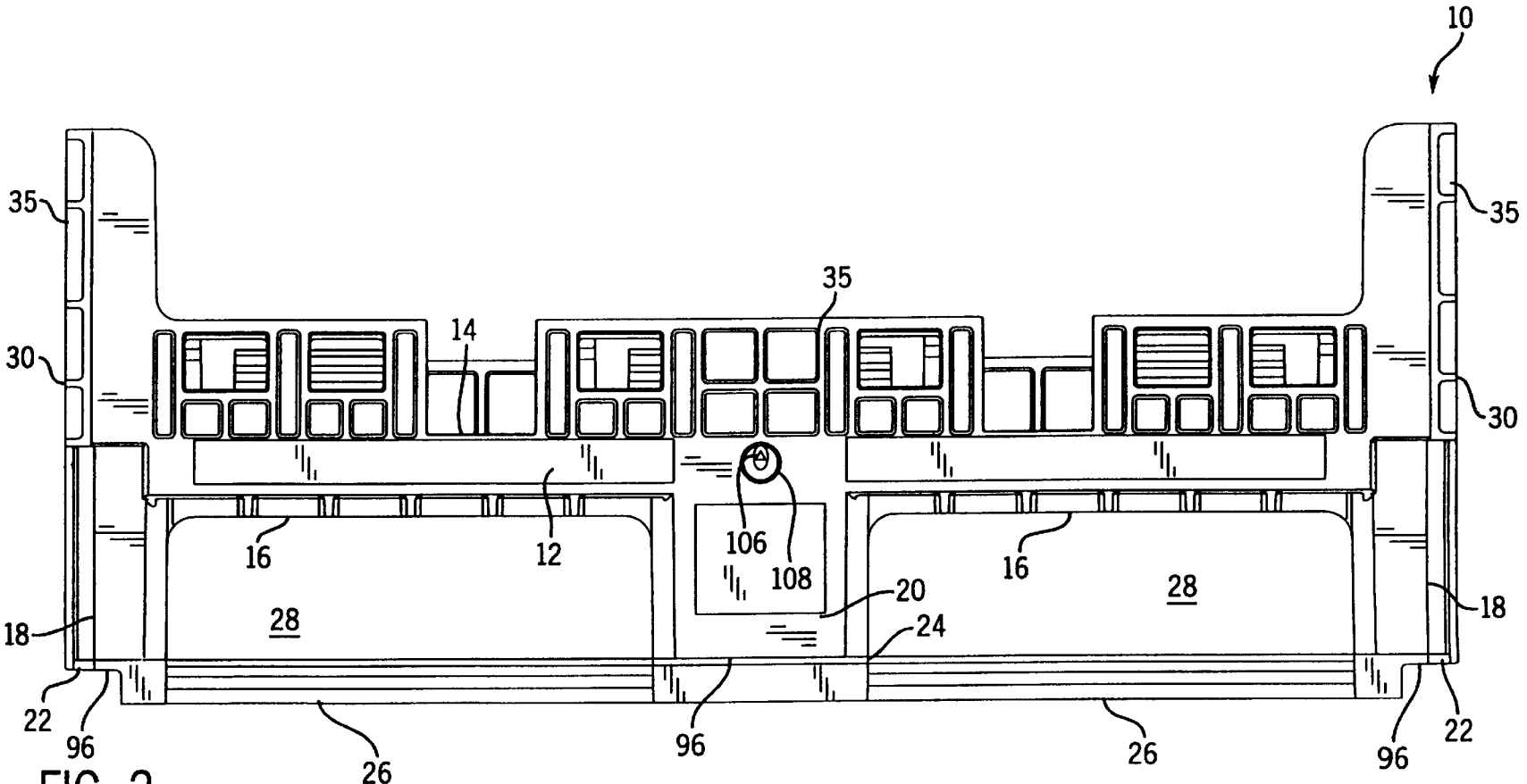
FIG. 2 is an end view of FIG. 1.

Referring to FIGS. 1 and 2, a pallet 10 has a deck 12 with a top 14 and a bottom 16. The deck 12 is supported by a plurality of legs 18, 20 which are integrally formed as part of the deck 12. Feet 22, 24 joined together by stringers 26 are slidably connected to the legs 18, 20 providing height adjustable openings 28 between the deck bottom 16 and stringers 26. The pallet 10 is lifted using forks (not shown) mounted on material handling equipment (not shown), such as a fork lift, pallet jack or the like having lifting forks, which are inserted into the height adjustable openings 28 and engage the deck bottom 16.

The pallet 10 is substantially rectangular having two opposing sides 30 substantially parallel to a longitudinal axis 32 joined together by two opposing ends 34 substantially parallel to a lateral axis 34. Walls 35 extending upwardly from the deck top 14 along the sides 30 and ends 34 prevent a load on the deck top 14 from slipping off during transport. Preferably, the pallet 10 and walls 35 are formed from a molded thermoplastic material, such as polyethylene, using a molding method, such as injection molding or the like.

Two side legs 18 at opposing sides 30 of the deck 12, and a middle leg 20 interposed between each side leg 18 supports each end and the center of the deck 12. Preferably, each side leg 18 supports a pallet corner 38. Central side legs 19 are provided in the center of the sides 30 and have extensions 21 with bottoms in the floor engaging plane of the bottoms of the feet 22, 24 and stringers 26. A central leg 25 is also provided in the center of the pallet, having a bottom in the plane of the bottoms of the extensions 21, feet 22, 24 and stringers 26 (when the feet 22, 24 are fully inserted in the legs 18, 20). Although, only the legs along the ends 34 are provided with stringers, all of the legs supporting the pallet deck could be provided with telescoping feet and connecting stringers without departing from the scope of the present invention.

Figure 3:
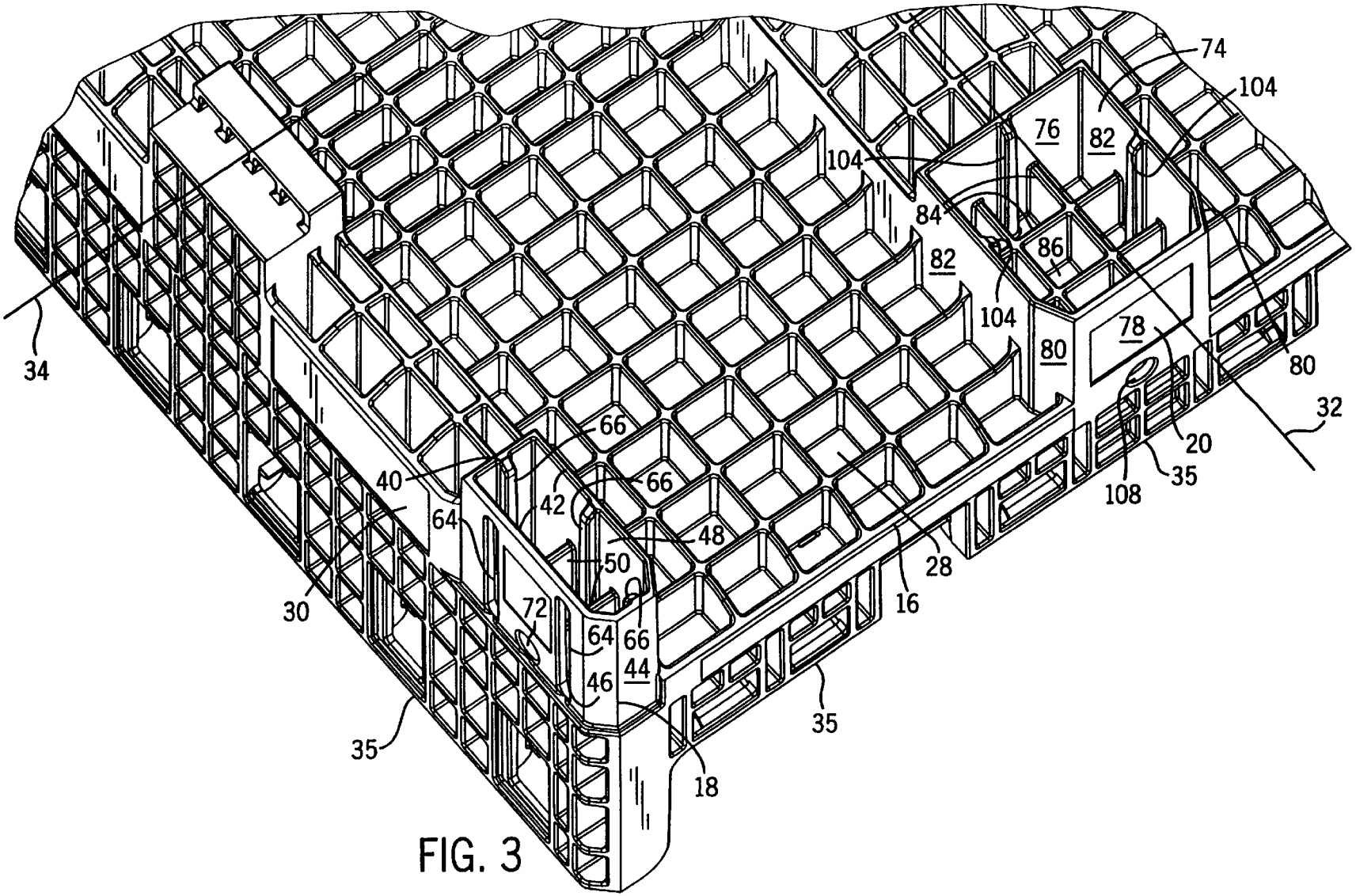
FIG. 3 is a detail view of FIG. 1 with the feet removed.

Referring to FIG. 3, the pallet side legs 18 help support the pallet sides 30 and are generally hollow and bullet shaped, having an inner side 40 substantially parallel to the lateral axis 34, a pair of spaced sides 42 substantially parallel to the longitudinal axis 32 and Joined by the inner side 40, a nose 44 pointing outward away from the pallet interior, and an open bottom 48. The nose 44 guides lift equipment into the opening 28 between the middle leg 20 and an adjacent side leg 18. Spaced ribs 50 formed in the leg top 46 guide the foot 22 as it extends and retracts in the leg 18. Advantageously, the ribs 50 also strengthen the leg 18, providing structural stability to the leg sides 42.

Figure 4:
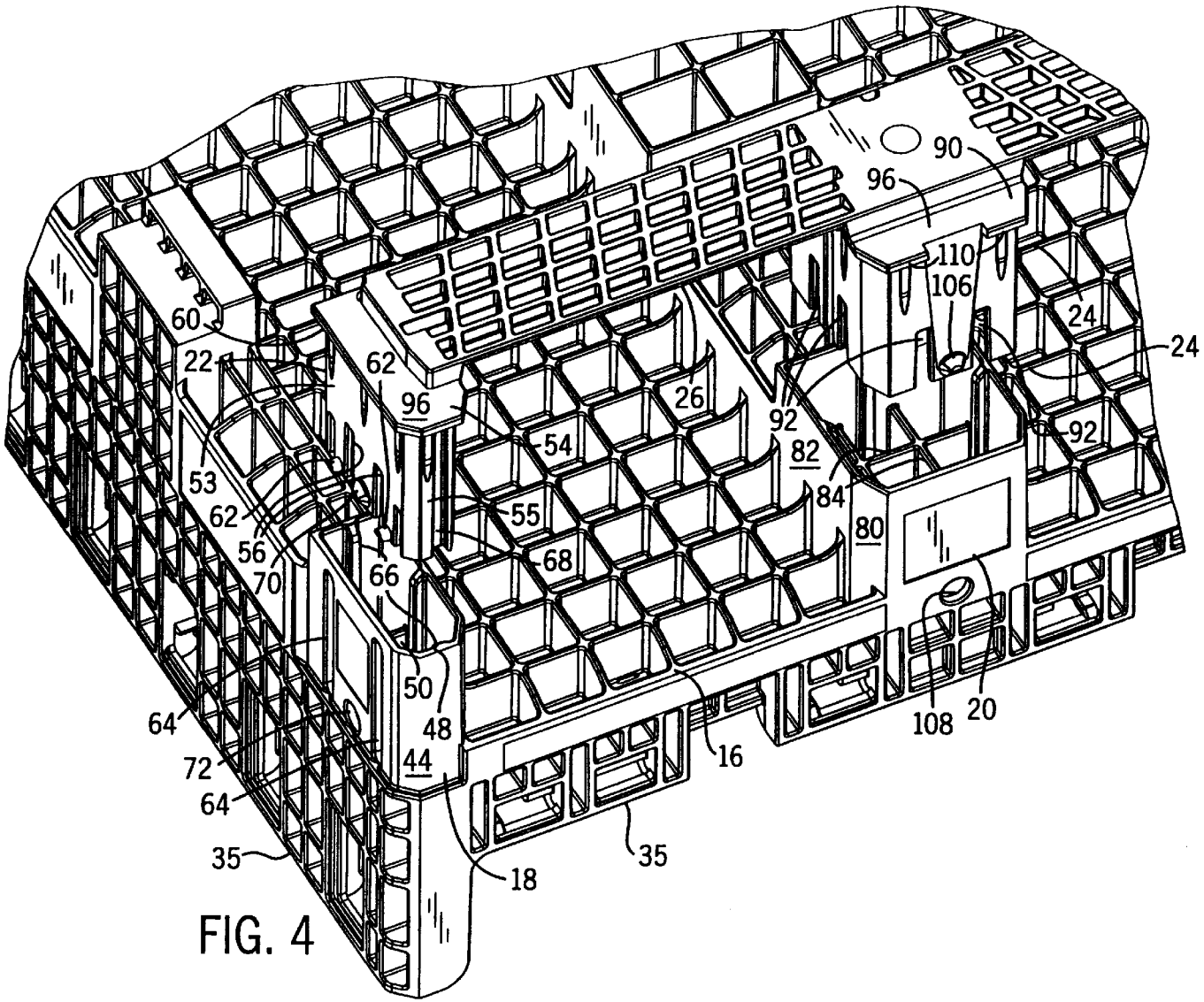
FIG. 4 is an exploded detail view of FIG. 1.
Figures 5, 6:
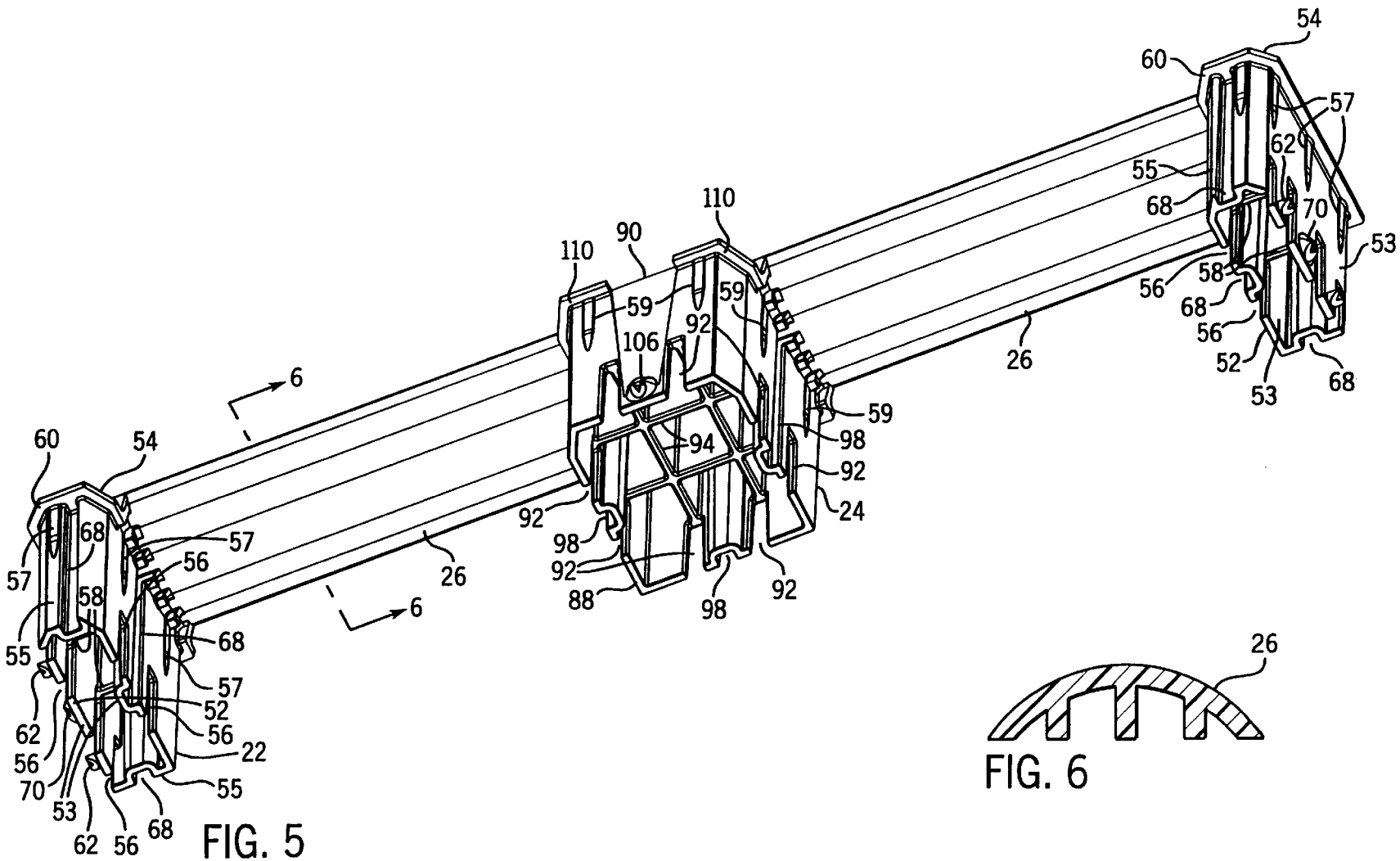
FIG. 5 is a top perspective view of the feet and stringer of FIG. 1.
FIG. 6 is a profile view along line 6—6 of FIG. 5.

As shown in FIGS. 4 and 5, a generally hollow side foot 22 is slidably inserted into the side leg bottom 48 has an open top 52, closed bottom 54, sidewalls 53, endwalls 55, and a cross sectional shape corresponding to the leg 18 cross section. The foot top 52 is disposed inside the leg 18, and the foot bottom 54 extends out of the leg bottom 48 for engagement with a supporting surface. The outer dimensions of the side foot 22 are proportioned so as to form a close sliding fit with the inside dimensions of the side leg 18. Notches 56 formed in the foot top 52 are adapted to accommodate and cooperate with the ribs 46 formed in the leg 18 to guide the telescoping foot 22.

Structural ribs 58 formed between the spaced foot sides 53 inside the foot 18 provide structural integrity to the foot 22 to increase the load bearing capacity of the pallet 10. A lip 60 formed around portions of the foot bottom 54 having an outer dimension corresponding to the outer dimension of the leg 18 provides a finished look when the foot 22 is fully retracted into the leg 18 and stops the foot 22 from sliding past a retracted position further into the leg 18.

Tabs 62 formed on the outside of a foot sidewall 53 are received in slots 64 formed in the leg 18 and guide the foot 22 as it telescopes in and out of the leg 18 to prevent skewing. The engagement of the tabs 62 in the slots 64 define the telescoping limits or stops of the foot 22, thus preventing the foot 22 from slipping out of the leg 18 when fully extended. Similarly, keys 66 (three in each leg) formed in the leg endwall 40, inner sidewalls 42, and nose 44 are received in keyways 68 formed in the foot 22 further guiding the foot 22 as it telescopes in and out of the leg 18.

A generally conical nub 70 (being round and having upper and lower ramped surfaces ) formed in the foot sidewall 53 proximate to the foot top 52 is received in an aperture 72 formed in the leg 18 proximate the deck 12 locks the foot 22 in a retracted position, so that when the pallet is properly lifted (without extending the feet) the feet stay retracted. The foot 22 is unlocked by forcibly slidably moving the foot 22 in a downwardly direction, such as by inserting a lift truck fork having a height greater than the height of the opening 28, or by operating a pallet truck which has been inserted into the opening 28.

Ramped tolerance tighteners 57 formed on the foot side 53 and end 55 wall outer surfaces proximate the foot bottom 54 take up manufacturing tolerances in the foot 22 and leg 18, thus providing a snug fit between the retracted foot 22 and leg 18. Advantageously, the tolerance tighteners 57 aid in retaining the foot 22 in the retracted position to prevent inadvertent extension from the leg 18.

As shown in FIGS. 1–3, the middle leg 20 interposed between the two side legs 18 has an open bottom 74, an inner endwall 76 substantially parallel to the lateral axis 34 and an outer endwall 78 having beveled edges 80. The inner and outer endwalls 76, 78 are joined by a pair of spaced sidewalls 82 substantially parallel to the longitudinal axis 32. The outer endwall beveled edges 80 guide lift equipment forks into the opening 28 between the middle foot 20 and an adjacent side foot 18. Structural ribs 84 defining a grid formed in the middle leg top 86 guide the telescoping foot 24 and improves the structural integrity of the leg 20.

Referring to FIGS. 4 and 5, a middle foot 24 slidably inserted into the middle leg bottom 74 has an open top 88, closed bottom 90, and a cross sectional shape corresponding to the middle leg 20 cross sectional shape with the top 88 disposed inside the leg 20 and the bottom 90 extending out of the leg bottom 74. The outer dimensions of the middle foot 24 are proportioned so as to form a close sliding fit with the inside dimensions of the middle leg 20. As in the side feet 22, notches 92 formed in the foot top 88 are adapted to accommodate and cooperate with the ribs 84 formed in the leg 20, thus allowing the foot 24 to be retracted up into the leg 20 with minimal skewing. Structural ribs 94 are also formed inside the middle foot 24 providing improved structural integrity to the foot 24.

Keyways 98 formed in two sides 100 and the inner end 102 of the middle foot 24 receive corresponding keys 104 formed in the leg 20 inner endwall 76 and spaced sidewalls 82, and guide the foot 24 as it telescopes in and out of the leg 20 to prevent skewing.

A nub 106 and aperture 108 locking mechanism as described above in the side feet 22 and legs 18 is provided to hold the middle foot 24 in a retracted position. As in the side feet 22, a lip 110 formed around portions of the middle foot bottom 90 having an outer dimension corresponding to the outer dimension of the middle leg 20 provides a finished look when the foot 24 is fully retracted and stops the foot 24 from sliding further upwardly into the leg 18.

The walls that the tabs 62 and nubs 70, 106 are formed on extend vertically upwardly (in the orientation of the pallet when resting on its ground engaging bottom surface) from a more rigid lower part of the walls of the feet, and therefore act as cantilever springs. The upper sides of the tabs 62 and nubs 70, 106 are ramped so as to cam along the lower edges of the feet in which they are inserted. This camming flexes the cantilever spring walls inwardly until the tabs 62 clear their way into the respective holes 72, 108. The bottom side of nubs 70, 106 are also ramped, so as to permit extension of the feet, but the bottom sides of the tabs 62 are substantially perpendicular to the walls they extend from, so as to more aggressively resist the feet falling out of the legs.

As in the side feet 22, ramped tolerance tighteners 59 are formed on the middle foot 24 outer surfaces proximate the foot bottom 90. The tolerance tighteners 59 take up manufacturing tolerances in the foot 24 and leg 20, thus providing a snug fit between the retracted foot 24 and leg 20.

A stringer 26 formed as an integral part of a portion of the feet bottoms 54, 90 tie the side 22 and middle 24 feet together and define the lower boundary of the height adjustable opening 28 for inserting lifting forks. Advantageously, by forming the stringer 26 on a portion of the feet bottoms 54, 90, a surface 96 is formed in each foot for nesting stacked pallets 10 or supporting the pallet 10 on rack load arms (not shown). When nesting pallets 10 having walls 35, the surface 96 supports the upper pallet 10 on the walls 35 of the lower pallet 10.

As shown in FIGS. 1 and 6, the stringer 26 is substantially parallel to the lateral axis 34 having a dome shaped longitudinal cross section. The dome shaped cross section provides a smooth ingress and egress for forks having ground engaging wheels which are inserted between the stringer 26 and pallet deck bottom 16. Advantageously, the dome shaped stringer 26 allows the wheels to harmlessly roll over the stringer 26.

In operation, the height of the adjustable height opening 28 for insertion of material handling forks is increased by forcibly inserting a lift truck fork having a height greater that the current opening 28 height. The fork engages the deck bottom 16 and stringer 26 forcibly extending the feet 22, 24 in the transverse (vertical) direction out of the pallet legs 18, 20 to increase the distance between the stranger 26 and the deck bottom 16. Advantageously, the slidable connection between the pallet legs 18, 20 and corresponding feet 22, 24 accomplishes the opening height adjustment without damaging the deck 12 or stringer 26. Tabs 62 engaging in the lower ends of the slots 64 keep the feet 22, 24 from falling out of the legs if the pallet is picked up with the feet 22, 24 extended.

The height of the opening 28 is decreased by removing the forks from the opening and allowing the weight of the load to force the feet 22, 24 back into the retracted position inside the legs 18, 20. In the retracted position, the nub 70, 106 and aperture 72, 108 locking mechanisms retain the feet 22, 24 inside the legs 18, 20 until a fork or other object forcibly extends the feet 22, 24 from the legs 18, 20.

While there has been shown and described a preferred embodiment of the invention, it will be obvious to those skilled in the art that various changes and modifications will be apparent to those skilled in the art which can be made without departing from the spirit of the invention. For example, the invention could be applied to a partial-walled crate as illustrated, to a full walled crate, or to a pallet all of which have load conveying platforms. Therefore, the invention should not be limited to the embodiment described, but should be defined by the claims which follow.

We claim:

1. A load conveying platform comprising:

a deck for supporting said load;

at least two legs having a space therebetween, said legs depending downwardly in a transverse direction from said deck;

at least two corresponding feet having tops and bottoms, each of said feet being slidably connected in the transverse direction to one of said legs, said feet being slidably movable with respect to said legs between an extended position and a retracted position;

a stopping mechanism having a portion on at least one leg which abuts a portion on a corresponding foot to resist further extension of said feet beyond said extended position; and a stringer mounted to said feet spanning said space between said feet.

2. A load conveying platform as in claim 1, in which said legs are formed as an integral part of said deck.

3. A load conveying platform as in claim 1, in which said feet are formed as an integral part of said stringer.

4. A load conveying platform as in claim 1, in which each of said foot tops are disposed in one of said legs.

5. A load conveying platform as in claim 1, including a guide formed in one of said legs for guiding slidable movement of said corresponding foot in said leg.

6. A load conveying platform as in claim 5, in which said guide is a tab extending from a wall of said foot which is received by a slot formed in said leg.

7. A load conveying platform as in claim 6, in which said tab has upper and lower ramped surfaces.

8. A load conveying platform as in claim 7, in which said lower ramped surface is substantially perpendicular to said wall of said foot.

9. A load conveying platform as in claim 5, in which said guide is a key formed on one of said legs or said corresponding foot, and a keyway formed on the other of said leg or corresponding foot.

10. A load conveying platform as in claim 1, including a second locking mechanism formed on one of said legs and con responding foot for locking said foot in said retracted position while permitting said foot to slide from said retracted position top said extended position if said foot and leg are forced apart without causing said foot and leg to become completely detached.

11. A load conveying platform as in claim 10, in which said second locking mechanism is a nub formed on one of said legs or said corresponding foot, and is received in an aperture formed on the other of said leg or corresponding foot.

12. A load conveying platform as in claim 11, in which said nub has upper and lower ramped surfaces.

13. A load conveying platform as in claim 1, in which said stringer has a dome cross section.

14. A load conveying platform as in claim 1, in which said stringer covers only a portion of said feet bottoms to provide a surface for engaging a support.

* * * * *

UNITED STATES PATENT AND TRADEMARK OFFICE

CERTIFICATE OF CORRECTION

PATENT NO. : 6,173,659 B1 
DATED : January 16, 2001
INVENTOR(S) : Christopher A. Danks, Randy H. Hafemeister, James W. Hammond, Ryan J. Andreae It is certified that error appears in the above-identified patent and that said Letters Patent is hereby corrected as shown below:

Column 4,
Line 64, before "26" [stranger] should be -- stringer --.

Claim 10,
Column 6,
Line 23, before "foot" [con responding] should be -- corresponding --.

Signed and Sealed this

Second Day of October, 2001

*Attest:*

Nicholas P. Godici

NICHOLAS P. GODICI
*Acting Director of the United States Patent and Trademark Office*

*Attesting Officer*